US009192851B2

(12) United States Patent
McCloud

(10) Patent No.: US 9,192,851 B2
(45) Date of Patent: Nov. 24, 2015

(54) BOWLING BALL AND PIN SEPARATOR

(71) Applicant: GENESIS BOWLING PRODUCTS, LLC, Angier, NC (US)

(72) Inventor: Steven Lanie McCloud, Willow Spring, NC (US)

( * ) Notice: Subject to any disclaimer, the term of this patent is extended or adjusted under 35 U.S.C. 154(b) by 21 days.

(21) Appl. No.: 14/026,432

(22) Filed: Sep. 13, 2013

(65) Prior Publication Data

US 2015/0080139 A1 Mar. 19, 2015

(51) Int. Cl.
*A63D 5/02* (2006.01)
*A63D 5/08* (2006.01)

(52) U.S. Cl.
CPC .. *A63D 5/02* (2013.01); *A63D 5/08* (2013.01); *A63D 5/023* (2013.01)

(58) Field of Classification Search
CPC ..... A63D 5/02; A63D 5/023
USPC ..... 473/73.98, 99, 106, 110–112
See application file for complete search history.

(56) References Cited

U.S. PATENT DOCUMENTS

| | | | | |
|---|---|---|---|---|
| 2,973,204 | A | 2/1961 | Huck | |
| 3,456,946 | A * | 7/1969 | Buck | 473/112 |
| 3,704,888 | A | 12/1972 | Kleineaschoff | |
| 3,822,882 | A * | 7/1974 | Easterly | 473/110 |
| 4,320,897 | A * | 3/1982 | Fields | 473/106 |
| 5,429,554 | A | 7/1995 | Burkholder | |
| 5,759,108 | A | 6/1998 | Heddon | |
| 6,533,673 | B2 | 3/2003 | Wilson | |
| 7,115,040 | B1 | 10/2006 | Thorson | |
| 7,156,746 | B2 | 1/2007 | Scripps | |
| RE39,886 | E | 10/2007 | Wilson | |
| 7,591,732 | B2 | 9/2009 | Speigl | |
| 2013/0260908 | A1 * | 10/2013 | Bashak | 473/73 |

OTHER PUBLICATIONS

Pinsetter Parts Plus LLC, Ball Wheel Pin Deflector, available at http://www.pinsetterpartsplus.com/BallWheelPinDeflector.htm (last viewed Dec. 3, 2012), United States.

Brunswick Bowling & Billiards Corp., Spinning Ball Eliminator II Installation Instructions, Jun. 2010, United States.

* cited by examiner

*Primary Examiner* — William Pierce
(74) *Attorney, Agent, or Firm* — Olive & Olive, P.A.

(57) ABSTRACT

A bowling ball and pin separator to prevent bowling pins from being caught up by a ballwheel within an electromechanical pinsetter machine. The separator includes a base plate, a hinge with a spring, and a rigid arm. The hinge connects the rigid arm to the base plate, and the spring provides sufficient tension such that only the weight of a bowling ball is enough to cause the arm to be moved. In certain embodiments, the rigid arm is an elongated member having a plurality of bends.

18 Claims, 8 Drawing Sheets

BOWLING BALL AND PIN SEPARATOR

FIELD OF THE INVENTION

This invention relates to devices and methods for use in bowling machines to assist in separation of bowling balls and bowling pins.

BACKGROUND

Pinsetter machines for bowling centers have existed for over fifty years. Most of these machines operate electromechanically. Although these machines are a great improvement over methods where pins are reset by hand, the pinsetter machines currently available have room for improvement.

Many of these machines have ballwheel arrangements to separate bowling balls from the pins during resetting and other operations. One major problem with the models of electromechanical pinsetter machines having ballwheels is damage caused to pins, balls, and even the ball lift rod or other parts of the pinsetter machines. This damage often occurs due to the failure of the pinsetter machine to properly separate the pins from a ball after the deck has been cleared. One or more pins may be caught up with the ball on the ballwheel, and either or both the pins and balls may be damaged. Specifically, one or more pins may cause the ball to be wedged between a lift rod and a shaker board of the machine, which results in the ball being damaged by the ball wheel. Other times, one or more pins may get caught up in a lift rod, possibly becoming damaged itself and/or causing damage to the ball as the ballwheel spins it up the lift rod. Sometimes components of the pinsetter machines themselves, such as the lift rod, are damaged by such jams. Bowling balls may cost hundreds of dollars, and the cost of repair or replacement is almost always borne by the bowling center. While bowling pins are not as expensive, replacing them incurs some cost and can add up over time. Pinsetter machine parts may also be expensive, and the lane down time for a pinsetting machine requiring repair also may cause the bowling center to lose business.

Bowling center mechanics have long sought to alleviate this problem through slowing down the ballwheels and/or installing springs, bungee cords, and various other items within the pinsetter machine. While some of these attempted improvements help to limit these problematic occurrences, they are often unsuccessful and do not hold up to the wear and tear of use. These attempted improvements are also less than ideal since slowing down the operation of the pinsetter machine results in slower games, resulting in fewer games played and less money spent at the bowling center.

BRIEF SUMMARY OF THE INVENTION

In one aspect, the subject invention is a device for separating bowling balls and pins. In another aspect, the invention is a device that may be used in an existing electromechanical pinsetter machine, such as the Brunswick models A, A2, and Jetback to separate bowling balls and pins.

In yet a more specific aspect, the invention involves a bowling ball and pin separator that prevents bowling pins from being caught up in a ballwheel within a pinsetter machine. The separator includes a base plate, a hinge with a spring, and a rigid arm. The hinge connects the rigid arm to the base plate, and the spring provides sufficient tension such that only the weight of a bowling ball is enough to cause the arm to be moved. In certain embodiments, the rigid arm is an elongated member having a plurality of bends. In certain embodiments, the rigid arm may further include one or more components extending from or attaching to the elongated member.

In certain embodiments, the bowling ball and pin separator is attached to the rear casing of the pinsetter machine with the arm extending toward the ballwheel. The separator can be moved aside to allow a ball to connect with the ballwheel and deflect any pins which may have otherwise been caught up by the ballwheel.

DETAILED DESCRIPTION

Figure 1:
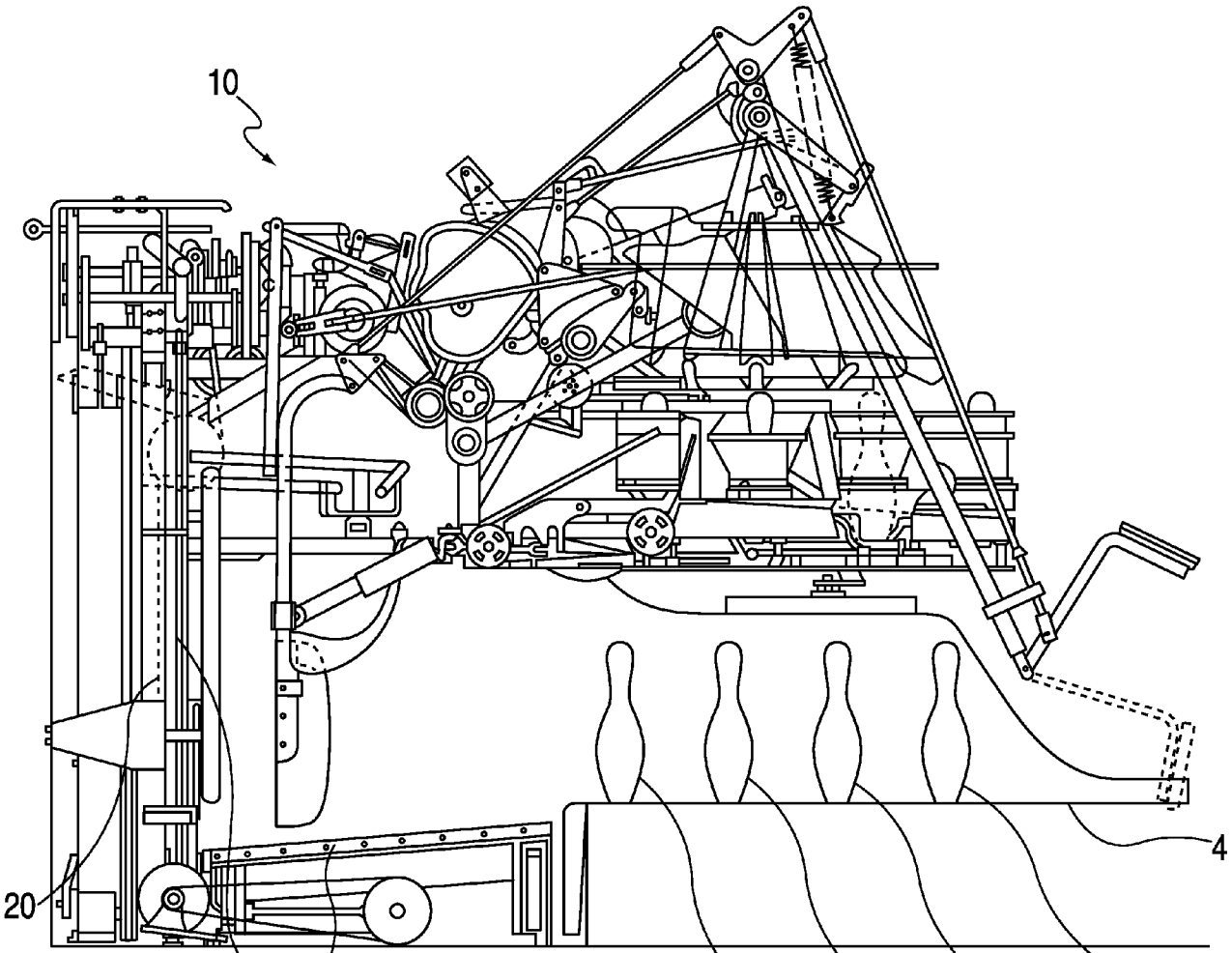
FIG. 1 (PRIOR ART)
FIG. 1 is side elevation view of a prior art automatic pinsetter of the type to which the invention is applied.
Figure 2:
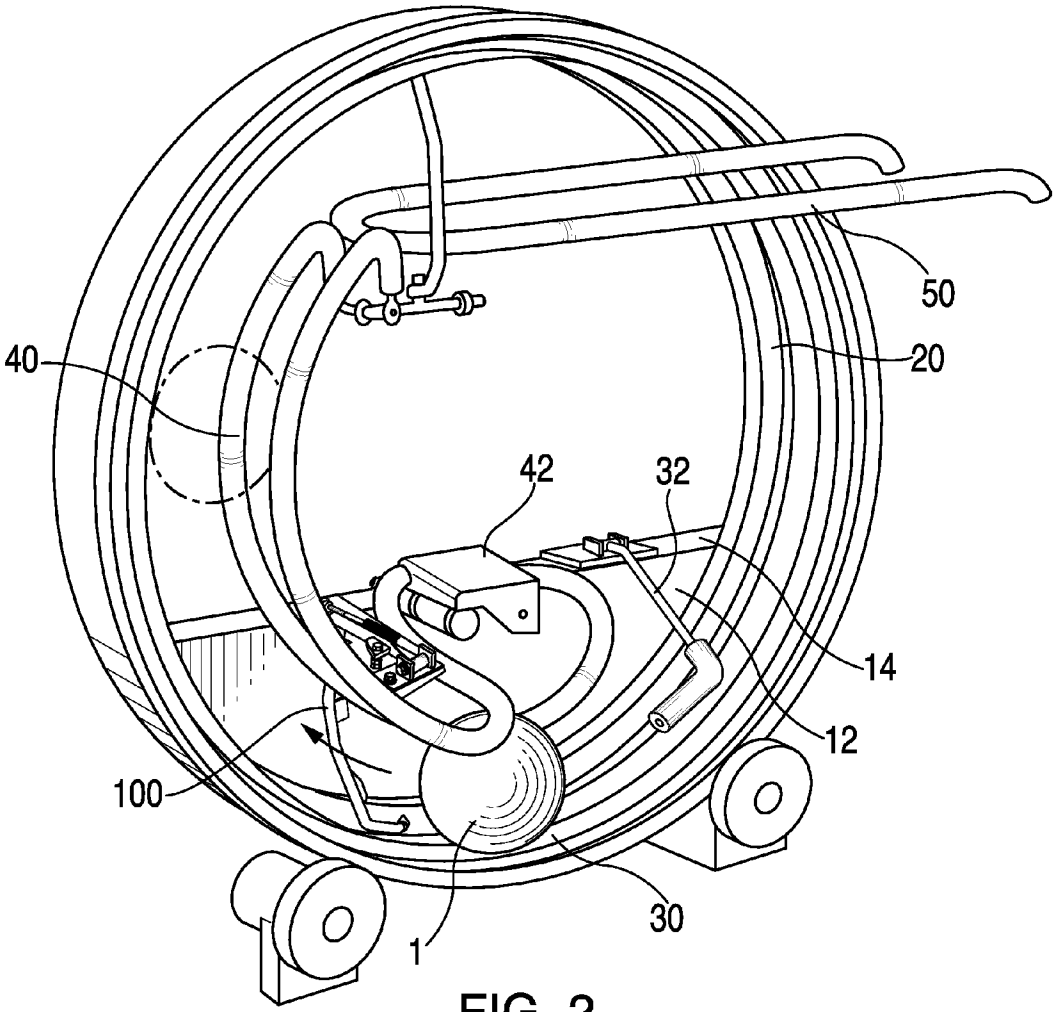
FIG. 2 is an isometric view of a ball return system with an embodiment of the separator.
Figure 3:
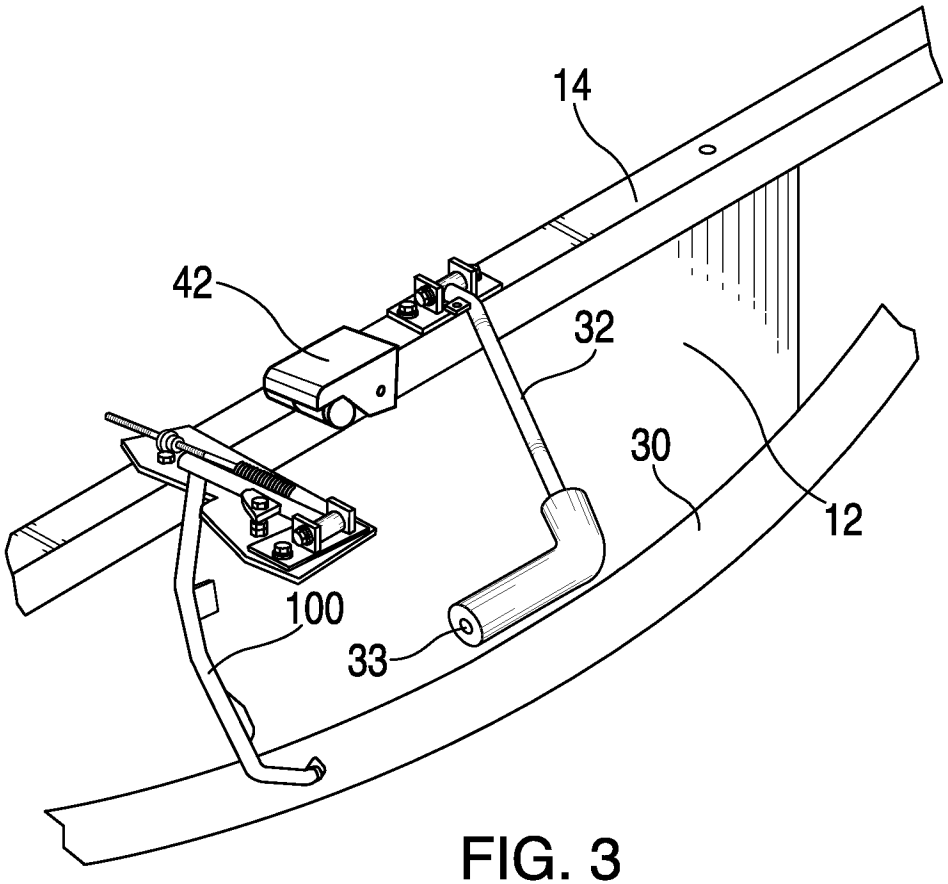
FIG. 3 is a close up, partial cutaway view of FIG. 2.
Figure 4:
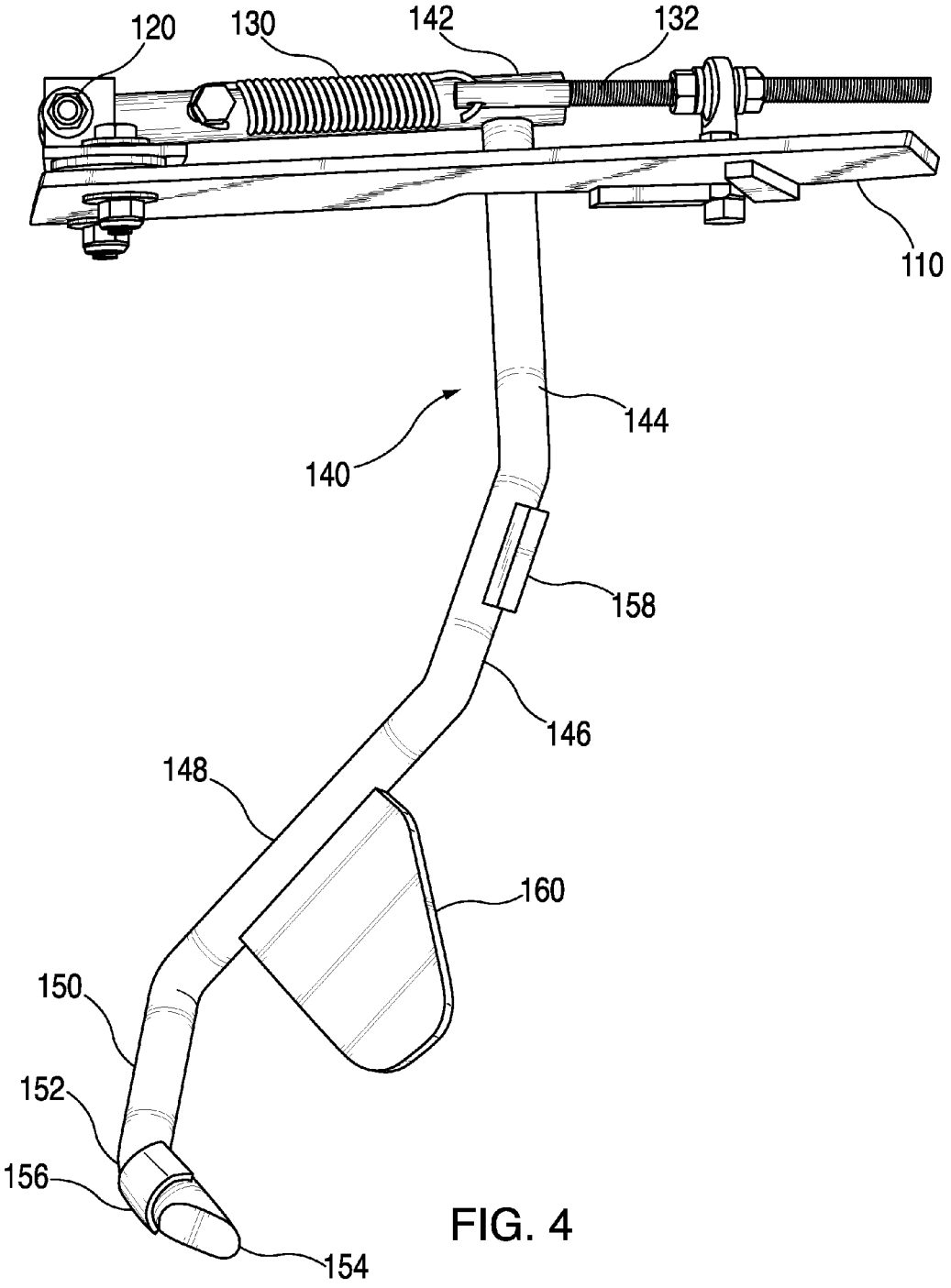
FIG. 4 is a side view of the embodiment of the separator depicted in FIG. 2.
Figure 5:
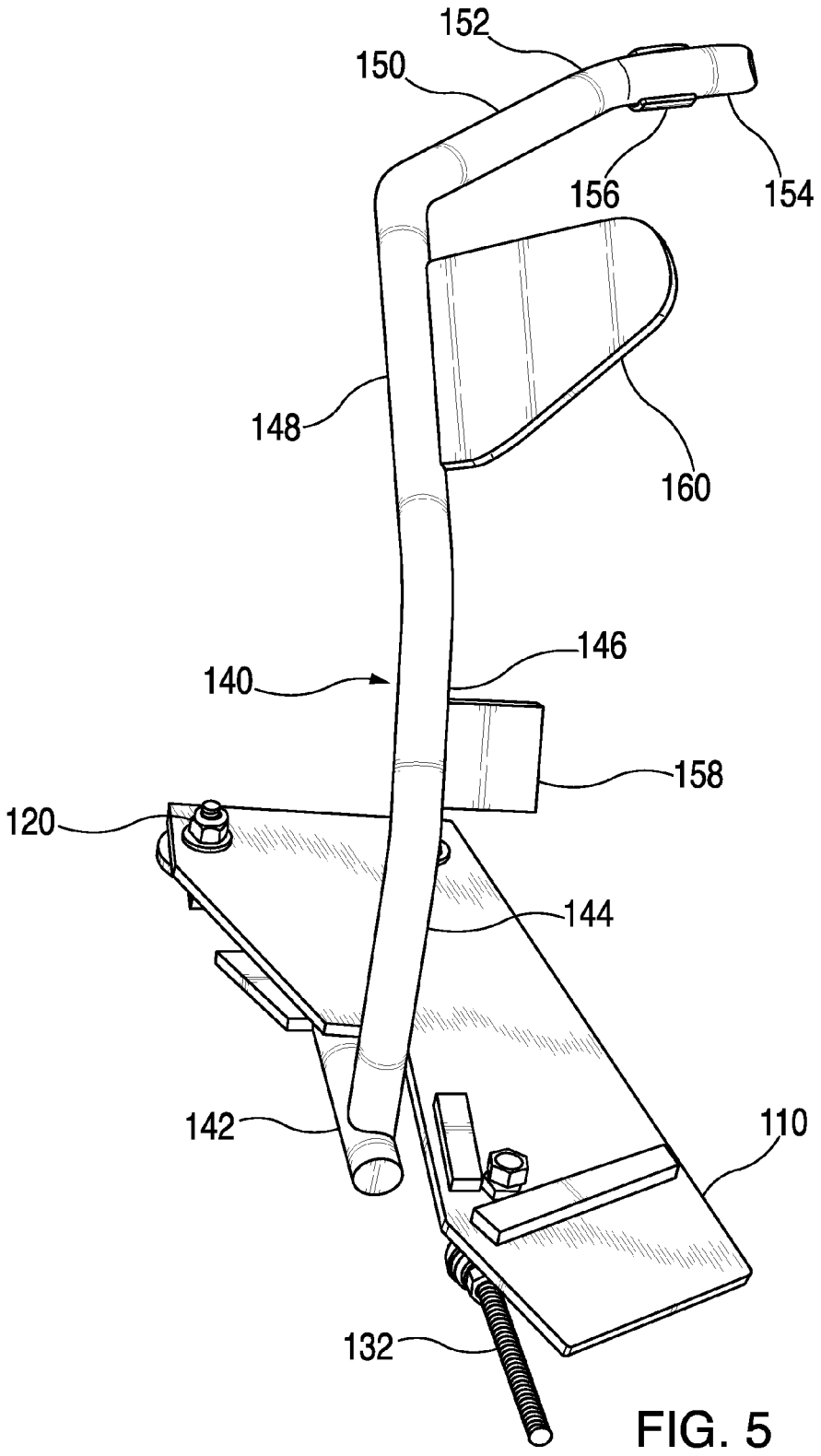
FIG. 5 is a front view of the embodiment of the separator depicted in FIG. 2.
Figure 6:
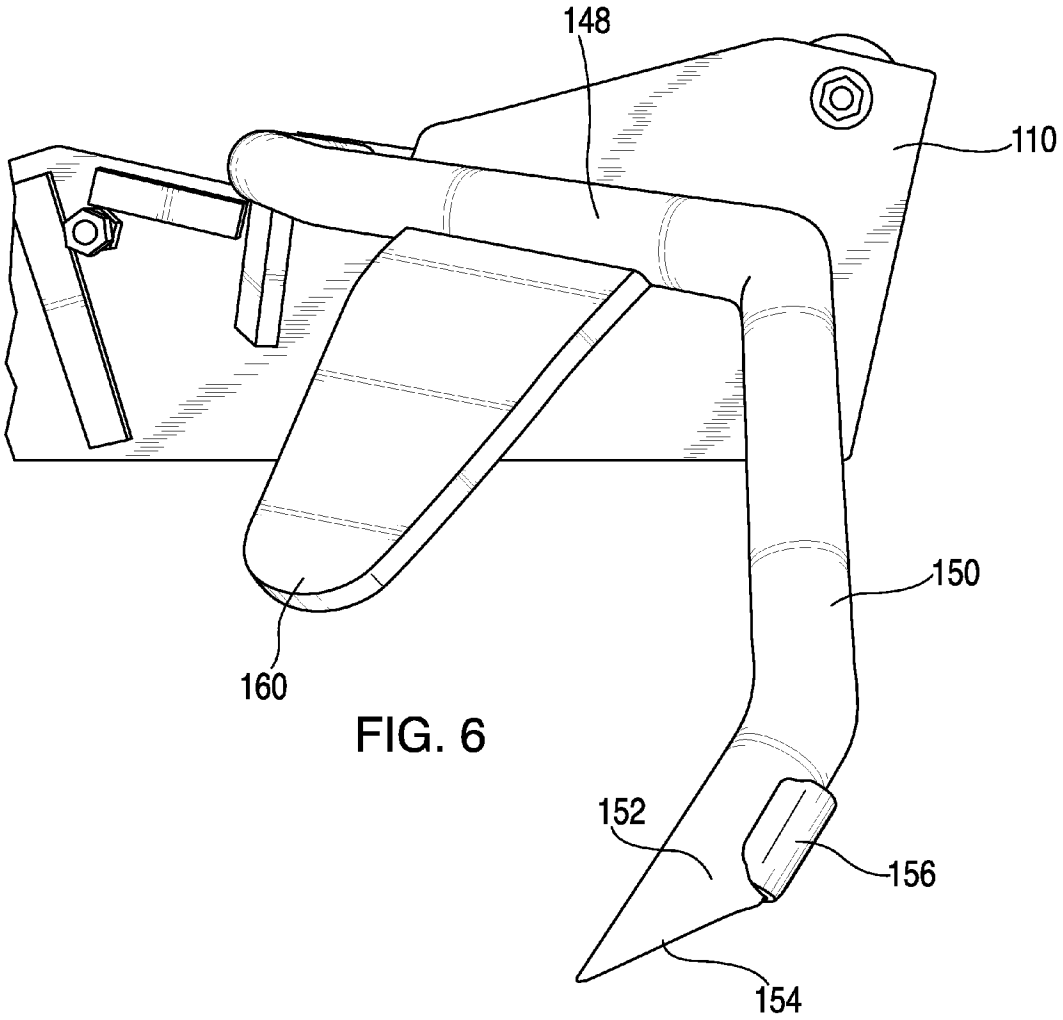
FIG. 6 is a bottom view of the embodiment of the separator depicted in FIG. 2.
Figure 7:
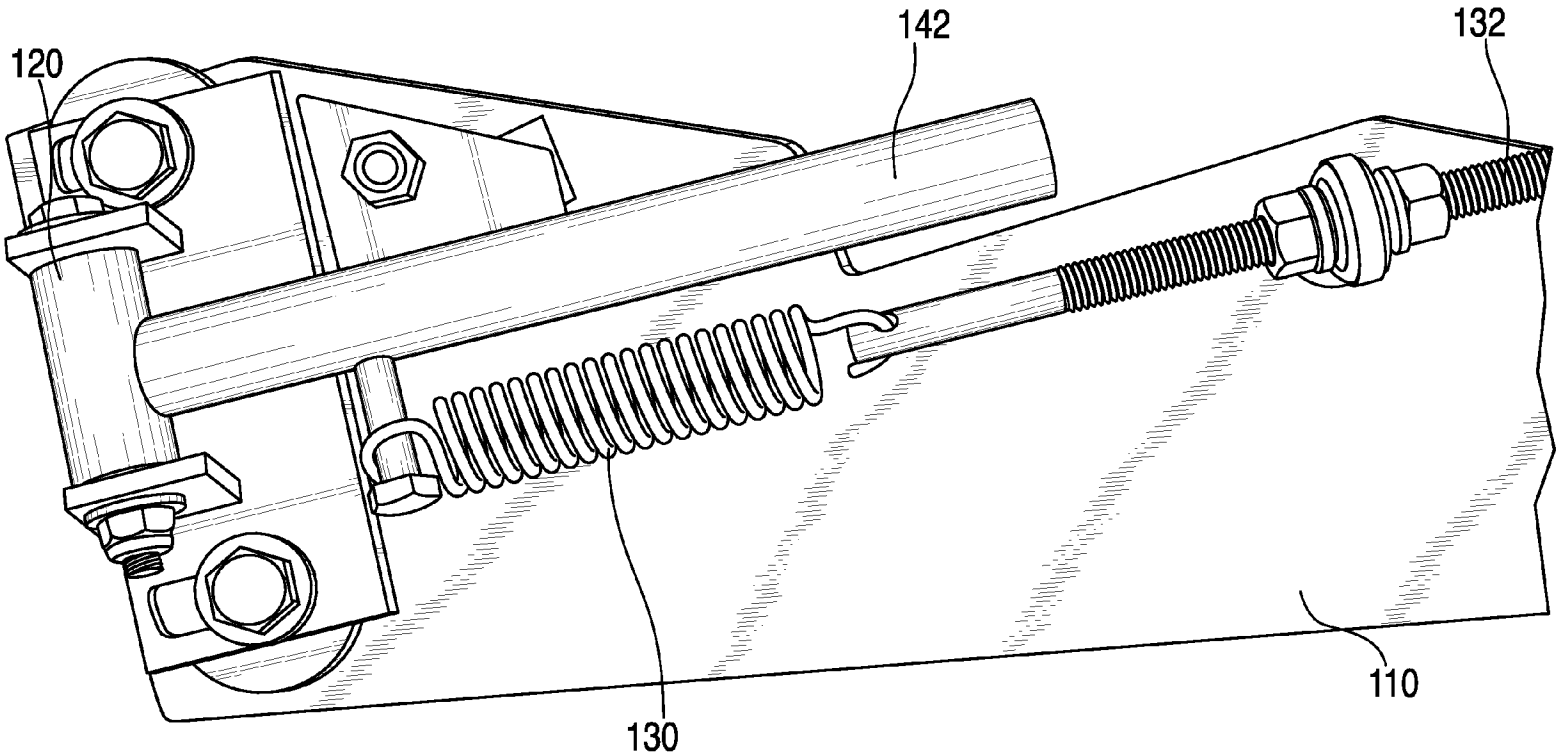
FIG. 7 is a top view of the embodiment of the separator depicted in FIG. 2.
Figure 8:
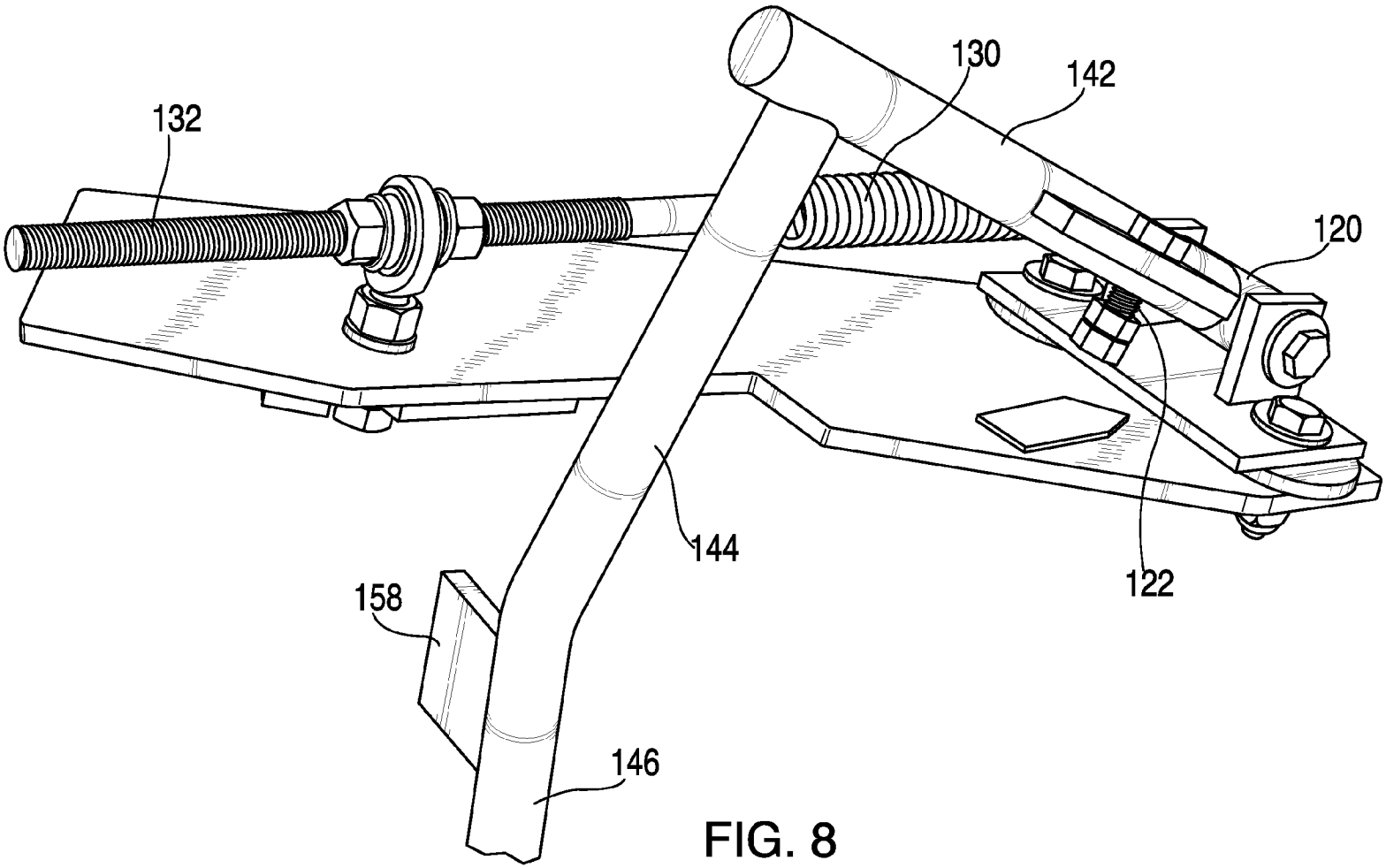
FIG. 8 is a perspective view of the upper portion of the embodiment of the separator depicted in FIG. 2.

As may be seen in FIGS. 1-3, a typical pinsetter 10, such as one known as the Brunswick Model A (depicted in FIG. 1 and U.S. Pat. No. 5,429,554) and its more recent derivatives, the A2 and Jetback models, generally include a casing 12, a shaker board 6, a pinwheel 20, a ballwheel 30, a ball spin arm 32, a pair of lift rods 40, and a ball track 50. The shaker board 6 is located at the end of a bowling lane 4 so that it may catch a ball 1 and a plurality of pins 2, 2', 2", 2'" each time a ball is thrown down the lane 4. As shown in FIG. 2, the pinsetter 10 includes two large spinning wheels, a pinwheel 20 and a ballwheel 30, which share a common axis centered to the lane 4. The ballwheel 30 generally has a uniformly smooth but non-skid surface on the inside, such as rubber, cork, or some combination thereof. The arrangement of the pinwheel 20 and the ballwheel 30 within the pinsetter is conventional, as embodied in various commercially available pinsetters such as the pinsetter known as the Brunswick Model A.

The lift rods 40 typically are made up of a pair of metal rods, typically covered in rubber or another non-skid material. The lift rods 40 are installed to fit within and to one side of the ballwheel 30 and have a base 42 that may be secured to the casing 12 along an installation rail 14. A ball track 50 is installed at the top of the lift rods 40 and connects to further components for returning a ball 1 to a bowler. The pinwheel 20 is generally located behind the ballwheel 30 and sometimes has pockets to capture the pins 2, 2', 2", 2'".

As shown in FIGS. 2 and 3, the pinsetter 10 may further comprise a ball spin arm 32. The spin arm 32 is generally a metal arm in approximately an L shape, with the lower portion 33 of the spin arm 32 covered in a non-skid material, such as rubber. The spin arm 32 may be secured to the casing 12 along an installation rail 14 just to the side of the lift rod base 42 on the opposite side from which the lift rods 40 extend. The lower portion of the spin arm 32 may rest a few inches away from the ballwheel 30.

As is relevant to the invention, the typical prior art pinsetter 10 provides for a ball 1 and a plurality of pins 2, 2', 2", 2'" to be pushed off the end of the lane 4 and onto the shaker board 6. The shaker board 6 agitates the ball 1 and pins 2, 2', 2", 2''' to cause them to move to the rear of the shaker board 6. When the ball 1 is at the rear of the shaker board 6, it comes into contact with the ballwheel 30. The ball spin arm 32 may prevent the ball from spinning so that it is more easily caught up by the ballwheel 30. The ball 1 then becomes wedged between the ballwheel 30 and the lift rods 40, is guided upward between the lift rods 40 and the spinning ballwheel 30, and then rolls onto the ball track 50.

As described above, problems are often encountered with this traditional configuration due to one or more pins 2, 2', 2", 2''' being caught up within the pinsetter 10. Installation of a separator 100, shown in FIGS. 2-8, will prevent most if not all of these problems.

The separator 100 includes a base plate 110, a hinge 120, a spring 130, a spring rod 132, and a rigid arm 140. The rigid arm 140, an embodiment of which is clearly shown in FIGS. 4-8, is an assembly of a plurality of sections at angles to one another. The rigid arm 140 may preferably is made up of angled sections extending from each other due to the existing design of the typical pinsetting machine 10. If the rigid arm 140 were perfectly straight in the pinsetting machine 10, it could not serve its purpose as its movement would be impeded by other components of the pinsetting machine 10, such as the lift rod base 42. Additionally, a straight embodiment of the rigid arm 140 may not be as effective since the pins 2, 2', 2", 2''' do not take straight paths. The pins 2, 2', 2", 2''' come from the lane 4 at varying angles and in various positions; an angled rigid arm 140 is more likely to successfully intercept and redirect the pins 2, 2', 2", 2''' toward the pinwheel 20.

As shown in the depicted embodiment, the rigid arm 140 may include six sections 142, 144, 146, 148, 150, 152 (further described below). The first section 142 is attached to the hinge 120 at one proximal end and to a second section 144. The spacer 122 and spring 132 may be attached to the first section 142 so that they are approximately parallel to the first section 142. When the hinge 120 is in the closed position, the first section 142 of the depicted embodiment rests approximately parallel to the base plate 110 and at approximately 70 degrees to the installation rail 14 (FIG. 2). At or near the proximal end opposite the one attached to the hinge 120, the first section 142 is attached to a second section 144.

The base plate 110 of the separator 100 provides a structure for attaching the separator 100 to the pinsetter casing 12 and, as configured in the depicted embodiment, a support for the hinge 120, spring rod 132, and rigid arm 140. In the depicted embodiment, the base plate 110 is an elongated, irregularly shaped metal plate. The base plate 110 may be installed by attaching the base plate 110 to the pinsetter casing 12 along the installation rail 14.

The rigid arm 140 attaches to the base plate 110 at a hinge 120. In the depicted embodiment, the rigid arm 140 is a shaped metal rod having a diameter of approximately 0.75 inches, but other materials and other sizes may be substituted as appropriate. The hinge 120 may be any type of hinge, though a single fulcrum hinge as depicted may be preferred for simplicity.

The movement of the rigid arm 140 from the hinge 120 may be restricted through attachment of a spacer 122 (FIG. 8) and a spring 130 and spring rod 132. The spacer 122 may be attached to the rigid arm 140 to prevent the rigid arm 140 from making direct contact with the base plate 110, thereby increasing the durability of the separator 100. Further, a spring 132 may be attached to the rigid arm 140 at one end and a spring rod 132 at the opposite end. The spring rod 132 may be attached to the base plate 110. The spring 132 should provide sufficient tension such that the weight of a bowling ball 1 pushing against the rigid arm 140 is sufficient to cause the rigid arm 140 to be moved at the hinge but such that the weight of a pin 2 is not sufficient to cause the rigid arm 140 to be moved.

In the depicted embodiment, the second section 144 of the rigid arm 140 extends downwardly in an approximately perpendicular orientation from the first section 142. When the hinge 120 is in the closed position, the second section 144 is approximately parallel to the pinsetter casing 12.

In the depicted embodiment, a third section 146 of the rigid arm 140 extends downward from the second section 144 and in a direction to deflect pins 2, 2', 2", 2''' attempting to enter the ballwheel 30.

In the depicted embodiment, a fourth section 148 of the rigid arm 140 extends downward from the third section 146 and in a direction to deflect pins 2, 2', 2", 2''' attempting to enter the ballwheel 30.

In the depicted embodiment, a fifth section 150 of the rigid arm 140 extends downward and to the side from the fourth section 148. The fifth section 150 is angled in a direction to deflect pins 2, 2', 2", 2''' attempting to enter the ballwheel 30. When the hinge 120 is in the closed position, the fifth section 150 is approximately parallel to the pinsetter casing 12.

In the depicted embodiment, a sixth section 152 of the rigid arm 140 extends from the fifth section 150 downward and toward the lift rod base 42. The sixth section 152 is angled in a direction to deflect pins 2, 2', 2", 2''' attempting to enter the ballwheel 30.

The sixth section 152 may further include components for further deflecting pins 2, 2', 2", 2''' away from the ballwheel 30. In the depicted embodiment, these components include a beveled tip 154 and a bumper 156, which is a section of material wrapped around at least a portion of the sixth section 152 facing toward the lane 4. The tip 154 is shaped as an angled end portion, the angled portion being directed toward the lane 4.

The rigid arm 140 may further include one or more deflector members, such as a plate extending from the rigid arm 140 to further assist in deflecting pins 2, 2', 2", 2". In the depicted embodiment, two deflector members, a flap 158 and a fin 160, are shown by way of example. In the depicted embodiment, the flap 158 is configured as a member in an approximately square shape protruding from the third section 146 toward the lift rod base 42. The fin 160 is a member in a fin shape that protrudes from the fourth section 148 toward the lift rod base 42.

The precise placement of separator 100 will be dictated by the configuration of the base plate 110 and length of the rigid arm 140. Generally, the separator 100 should be installed a distance sufficiently small that a pin cannot pass onto the ballwheel when hinge 120 is in the closed position. In a typical example, this is just a few inches away from the lift rod base 42 such that, when the hinge 120 is in the closed position, the sixth section 152 of the rigid arm 140 rests just above the inside edge of the ballwheel 30. Since the narrowest part of a standard bowling pin 2 typically measures 1.797 inches, in a specific embodiment, the section 152 should ideally be situated at about 0.1 to about 1.796 inches away from the inside edge of the ballwheel 30.

The precise configuration of the rigid arm 140, including the number of sections and the angles at which they extend, may vary as required by a number of factors. These factors include but are not limited to the type of pinsetting machine 10 on which the separator 100 is used and where the separator 100 is installed within the pinsetting machine 10.

As described above, a ball 1 and pins 2, 2', 2", 2''' are pushed by the pinsetter 10 onto the shaker board 6. The shaker board 6 agitates the ball 1 and pins 2, 2', 2", 2''' so that they are shifted to the back of the shaker board 6 toward the ballwheel 30 and pinwheel 20. When the ball 1 is at the rear of the shaker board 6, it comes into contact with the ballwheel 30. One or more pins 2, 2', 2", 2''' may also come into contact with the ballwheel 30 and may be guided upward by the ballwheel 30 toward the ball track 50. The ball 1 will come into contact with the separator 100. The weight of the ball 1 will cause the hinge 120 to be engaged such that the rigid arm 140 lifts up and back, allowing the ball 1 to continue its movement up the ballwheel 30 and onto the ball track 50. Any pins 2, 2', 2", 2''' directed upward by the ballwheel 30 will also come into contact with the separator 100. The weight of the pins 2, 2', 2", 2''' will not be sufficient to cause the hinge 120 to be moved; accordingly, the separator 100 will remain in place, blocking any pins 2, 2', 2", 2''' from continuing up the ballwheel 30. Incorporation of this improvement will allow a pinsetter 10 to function at its maximum speed, speeding up the return of the ball 1 and the setup of the pins 2, 2', 2", 2''' and allowing for faster games.

The foregoing details are exemplary only. Other modifications that might be contemplated by those of skill in the art are within the scope of this invention, and are not limited by the examples illustrated herein. In addition, it is noted that an Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A pinsetter device, comprising:

a. a pinsetter casing;

b. a ballwheel device within said casing for lifting a bowling ball to be returned; and c. a ball and pin separator, said ball and pin separator comprising:

i. a base plate for attaching to the pinsetter casing next to a lift rod base to a first side, ii. a movable rigid arm having a distal end that rests a distance from the ballwheel device sufficient to prevent bowling pins from entering the ballwheel device, and i. said base plate having a hinge mounted thereon, and having a spring connected at one end to the base plate, and the spring connected at another end to a proximal end of the rigid arm with the rigid arm connected to the hinge and to the spring in a manner to apply sufficient spring tension to urge the rigid arm into a position blocking entry into the ballwheel device, and sufficient tension to prevent said rigid arm from moving when contacted at the distal end by a pin to thereby prevent the pin from entering the ballwheel device, and insufficient tension to prevent the right arm from moving when contacted by a bowling ball to move and allow the bowling ball into the ballwheel device.

2. A pinsetter device as in claim 1, wherein said pinsetter device further comprises a pair of lift rods secured to the casing at a lift rod base, and extending within and parallel to a first side of the ballwheel for frictionally guiding a bowling ball to a ball return track.

3. In a pinsetter device having a casing with a ballwheel device therein for lifting a bowling ball to a ball return track, a ball and pin separator, comprising:

a. a base plate for attaching to the pinsetter casing next to a lift rod base to a first side;

b. a movable rigid arm having a distal end, and of a size that when assembled on the pinsetter device rests a distance from the ballwheel device sufficient to prevent bowling pins from entering the ballwheel device; and c. said base plate having a hinge mounted thereon, and having a spring connected at one end to the base plate, and the spring connected at another end to a proximal end of the rigid arm with the rigid arm connected to the hinge and to the spring in a manner to apply sufficient spring tension to urge the rigid arm into a position blocking entry into the ballwheel device, and sufficient tension to prevent said rigid arm from moving when contacted at the distal end by a pin to thereby prevent the pin from entering the ballwheel device, and insufficient tension to prevent the right arm from moving when contacted by a bowling ball to allow the bowling ball into the ballwheel device.

4. A ball and pin separator as in claim 3, wherein said hinge has a spring connected between the rigid arm and the base plate to provide the tension on the hinge.

5. The ball and pin separator as in claim 3, wherein the rigid arm is made up of a plurality of sections extending one from another at angles relative to each other to deflect bowling pins.

6. The ball and pin separator as in claim 3, further comprising: at least one deflector member extending from the rigid arm at a position to deflect bowling pins.

7. The ball and pin separator as in claim 5, wherein the rigid arm is made up of a first section, a second section, and a third section, and further comprising a deflector member extending from the third section of the rigid arm at a position to deflect bowling pins.

8. The ball and pin separator as in claim 5, wherein the rigid arm is made up of a first section, a second section, a third section, and a fourth section, and further comprising a deflector member extending from the fourth section of the rigid arm at a position to deflect bowling pins.

9. The ball and pin separator as in claim 3, wherein the rigid arm is made up of a first section, a second section, a third section, a fourth section, a fifth section, and a sixth section, and further comprising a bumper wrapped around at least a portion of the sixth section at a position to deflect bowling pins.

10. The ball and pin separator as in claim 3, further comprising: a spacer attached to the rigid arm for preventing the rigid arm from making contact with the base plate.

11. A pinsetter device as in claim 1, wherein said hinge has a spring connected between the rigid arm and the base plate to provide the tension on the hinge.

12. A pinsetter device as in claim 1, wherein the rigid arm is made up of a plurality of sections extending one from another at angles relative to each other to deflect bowling pins.

13. A pinsetter device as in claim 1, further comprising: at least one deflector member extending from the rigid arm at a position to deflect bowling pins.

14. A pinsetter device as in claim 1, wherein the rigid arm is made up of a first section, a second section, and a third section, and further comprising a deflector member extending from the third section of the rigid arm at a position to deflect bowling pins.

15. A pinsetter device as in claim 1, wherein the rigid arm is made up of a first section, a second section, a third section, and a fourth section, and further comprising a deflector member extending from the fourth section of the rigid arm at a position to deflect bowling pins.

16. A pinsetter device as in claim 1, wherein the rigid arm is made up of a first section, a second section, a third section, a fourth section, a fifth section, and a sixth section, and further comprising a bumper wrapped around at least a portion of the sixth section at a position to deflect bowling pins.

17. A pinsetter device as in claim 1, further comprising: a spacer attached to the rigid arm for preventing the rigid arm from making contact with the base plate.

18. A pinsetter device, comprising:

a. a pinsetter casing;

b. a ballwheel device within said casing for lifting a bowling ball to be returned; and c. a ball and pin separator, said ball and pin separator comprising:

i. a base plate for attaching to the pinsetter casing next to a lift rod base to a first side, ii. a movable rigid arm having a distal end that rests a distance from the ballwheel device sufficient to prevent bowling pins from entering the ballwheel device, and iii. said base plate having a hinge mounted thereon, and having a spring connected at one end to a spring rod connected to the base plate at a location spaced from the hinge, and the spring connected at another end to a proximal end portion of the rigid arm, and with the rigid arm connected to the hinge and to the spring in a manner to apply sufficient spring tension to urge the rigid arm into a position blocking entry into the ballwheel device, and sufficient tension to prevent said rigid arm from moving when contacted at the distal end by a pin to thereby prevent the pin from entering the ballwheel device, and insufficient tension to prevent the right arm from moving when contacted by a bowling ball to move and allow the bowling ball into the ballwheel device.

* * * * *